US006854489B2

(12) United States Patent
Tseng

(10) Patent No.: US 6,854,489 B2
(45) Date of Patent: Feb. 15, 2005

(54) MULTI-PURPOSE SHOELACE STRUCTURE

(75) Inventor: Tony Tseng, Taichung (TW)

(73) Assignee: Taiwan Paiho Limited, Changhua Hsien (TW)

( * ) Notice: Subject to any disclaimer, the term of this patent is extended or adjusted under 35 U.S.C. 154(b) by 97 days.

(21) Appl. No.: 10/428,116

(22) Filed: May 2, 2003

(65) Prior Publication Data

US 2004/0216799 A1 Nov. 4, 2004

(51) Int. Cl.[7] ..... A43C 7/00

(52) U.S. Cl. ..... 139/421; 139/384 R; 24/712.2; 24/715.3

(58) Field of Search ..... 139/421, 387 A, 139/384 A, 384 B, 384 R; 24/712.2, 715.3; 87/7, 10, 13

(56) References Cited

U.S. PATENT DOCUMENTS 1,513,871 A * 11/1924 Staniewicz ..... 24/715.3
1,848,318 A * 3/1932 Ciampi ..... 24/713
2,600,395 A * 6/1952 Domon et al. ..... 87/13
2,948,182 A * 8/1960 Huppertsberg ..... 87/2
3,330,011 A * 7/1967 Michael, Jr. ..... 24/715.4
5,062,344 A * 11/1991 Gerker ..... 87/8
5,080,142 A * 1/1992 Calamito et al. ..... 139/384 R
5,419,376 A * 5/1995 Hawkins et al. ..... 139/384 R
5,724,710 A * 3/1998 Hancock ..... 24/712.7
5,970,697 A * 10/1999 Jacobs et al. ..... 57/22
6,220,309 B1 * 4/2001 Sollars, Jr. ..... 139/389

* cited by examiner

*Primary Examiner*—John J. Calvert
*Assistant Examiner*—Robert H. Muromoto, Jr.
(74) *Attorney, Agent, or Firm*—Troxell Law Office PLLC

(57) ABSTRACT

A multi-purpose shoelace structure comprises a shoelace flatly woven via multiple layers of side-by-side warps yarns and weft yarns interlacing back and forth the warp yarns thereof. A left and a right branches are formed by the interlaced warp and weft yarns respectively with a multiple of interwoven sections disposed at preset positions of the left and right branches thereon, and a multiple of elastic tying sections, each separated from the others via the interwoven sections thereof, equidistantly defined by the left and right branches thereof. When the shoelace is stringed through buttonholes of a shoe body and tied up into a knot, both ends of the shoelace are led through the elastic tying sections thereof and be held there-between at the left and right branches thereof for double protection in case the knot gets loose when the users are walking, running, or cycling. Both ends of the shoelace can also be led through the elastic tying sections in crisscross manner for more variety thereof.

4 Claims, 5 Drawing Sheets

MULTI-PURPOSE SHOELACE STRUCTURE

BACKGROUND OF THE INVENTION

The present invention is related to a multi-purpose shoelace structure, comprising a shoelace flatly woven via multiple layers of side-by-side warps yarns and weft yarns interlacing back and forth the warp yarns thereof. A left and a right branches are formed by the interlaced warp and weft yarns respectively with a multiple of interwoven sections woven at preset positions of the left and right branches therewith, and a multiple of elastic tying sections, each separated from the others via the interwoven sections thereof, equidistantly defined by the left and right branches thereof. When the shoelace is stringed through buttonholes of a shoe body and tied up into a knot, both ends of the shoelace are led through the elastic tying sections thereof and be held there-between at the left and right branches thereof for double protection in case the knot gets loose when the users are walking, running, or cycling.

Please refer to FIGS. 1, 2. A conventional shoelace structure is mainly made up of a weaving article 10 woven by multiple side-by-side warp yarns 20, a left weft yarn 30, and a right weft yarn 31. The left and right weft yarns 30, 31, are correspondingly woven back and forth from both sides to interlace the multiple side-by-side warp yarns 20 and cross each other alternatively so as to strengthen the density and tightness of the weaving article 10 thereof. A multiple of buttonholes 12 are formed at the preset positions of the weaving article 10, each defining by a pair of adjacent left and right warp yarns 21, 22 to which the left and right weft yarns 30, 31 are woven thereto respectively and then bent backwards without crossing each other to disclose an opening there-between.

There are some drawbacks to such conventional shoelace structure. First, additional buttons or strings are required to be adapted to the buttonholes 12 of the weaving article 10 for location thereof, which makes it quite limited in practical use. Besides, the buttonholes 12 thereof are disclosed openly, making them easily hooked out of stitches thereof. Second, the weaving article 10, needle-woven, may have chinks disposed thereon due to the size of the weaving needles used when the left and right weft yarns 30, 31 are interlacing the warp yarns 20 thereof, resulting in a loose surface of the weaving article 10 which is easily deformed out of shape.

SUMMARY OF THE PRESENT INVENTION

It is, therefore, the primary purpose of the present invention to provide a multi-purpose shoelace structure, comprising a shoelace flatly woven via multiple layers of side-by-side warps yarns and weft yarns interlacing back and forth the warp yarns thereof to form a left and a right branches with a multiple of elastic tying sections equidistantly disposed at preset positions of the left and right branches thereof. When the shoelace is stringed through buttonholes of a shoe body and tied up into a knot, both ends of the shoelace are led through the elastic tying sections thereof and be held there-between at the left and right branches thereof for double protection in case the knot gets loose when the users are walking, running, or cycling.

It is, therefore, the secondary purpose of the present invention to provide a multi-purpose shoelace structure wherein both ends of the shoelace are easily and quickly double located via the elastic tying sections thereof without other buttons or strings required. Besides, the elastic tying sections can be flexibly stretched out or closed up, effectively preventing from being hooked out of stitches thereof.

It is, therefore, the third purpose of the present invention to provide a multi-purpose shoelace structure wherein the shoelace is flatly woven without any chinks produced in process of weaving due to the size of needles used, effecting a dense and tight surface of the shoelace thereof which is not easily deformed out of shape.

It is, therefore, the fourth purpose of the present invention to provide a multi-purpose shoelace structure wherein both ends of the shoelace doubly protected can also be led through the elastic tying sections thereof in crisscross manner for more variety in practical use

DETAILED DESCRIPTION OF THE PREFERRED EMBODIMENTS

Figure 1:
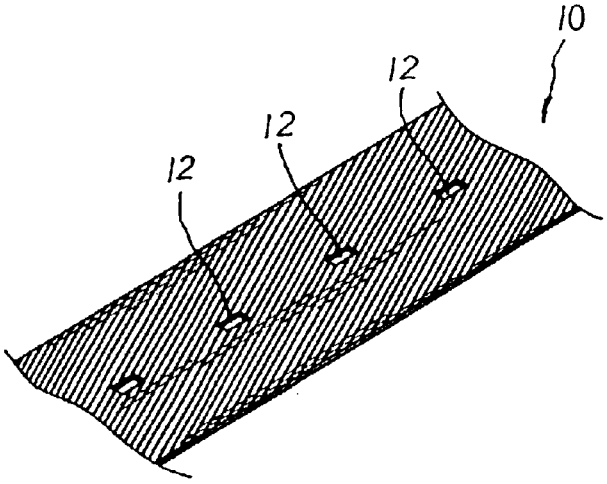
PRIOR ART FIG. 1
FIG. 1 is a diagram showing a conventional shoelace structure in finished product.
Figure 2:
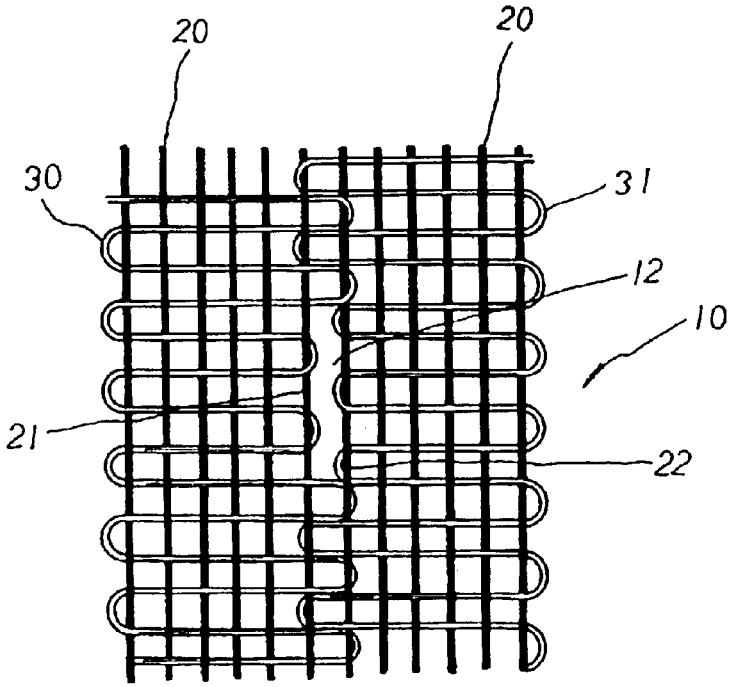
PRIOR ART FIG. 2
FIG. 2 is a partially enlarged view of the conventional shoelace structure.
Figure 3:
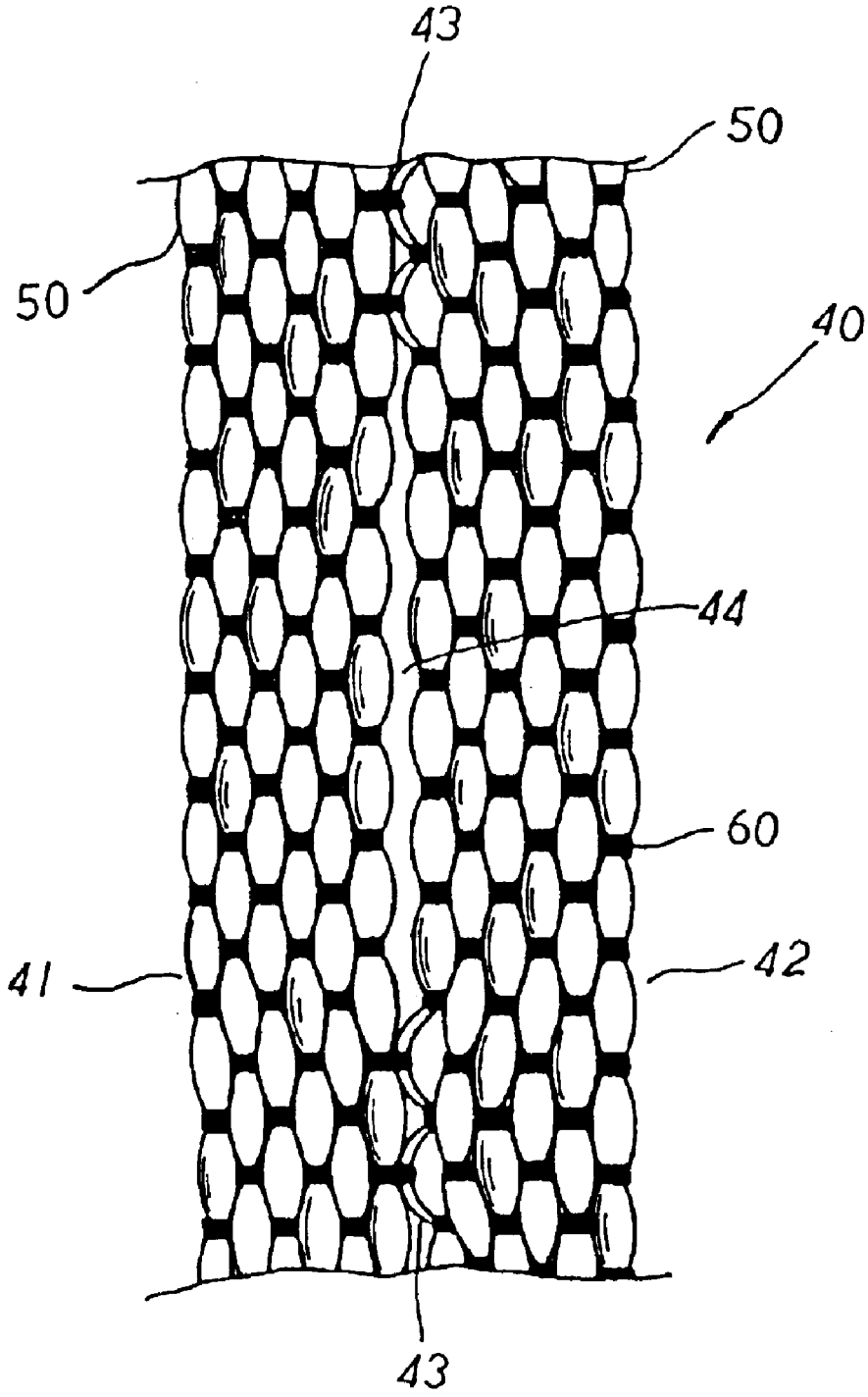
FIG. 3 is a diagram showing the present invention in finished product.
Figure 4:
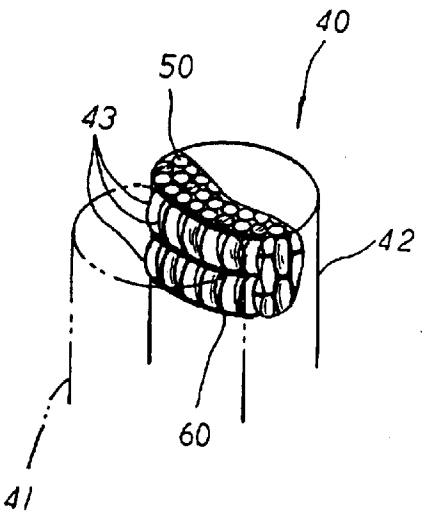
FIG. 4 is a partially enlarged view of the present invention.

Please refer to FIG. 3. The present invention is related to a multi-purpose shoelace structure, comprising a shoelace 40 flatly woven via multiple layers of side-by-side warps yarns 50, and weft yarns 60 interlacing back and forth the warp yarns 50 thereof. A left and a right branches 41, 42 are formed by the interlaced warp and weft yarns 50, 60 respectively. At preset positions of the left and right branches 41, 42, a multiple of interwoven sections 43, 43' are formed by weft yarns 60 equidistantly winding the inner side of the adjacent warp yarns 50 disposed at the right branch 42 thereof and then bent backwards at the left branch 41 as shown in FIG. 4. A multiple of elastic tying sections 44, each separated from the others by the interwoven sections 43, 43' thereof, are equidistantly defined by the left and right branches 41, 42 thereof. The elastic tying sections 44 thereof can be either stretched out or closed up, and may be adjusted in size according to that of the shoelace 40.

Figure 6:
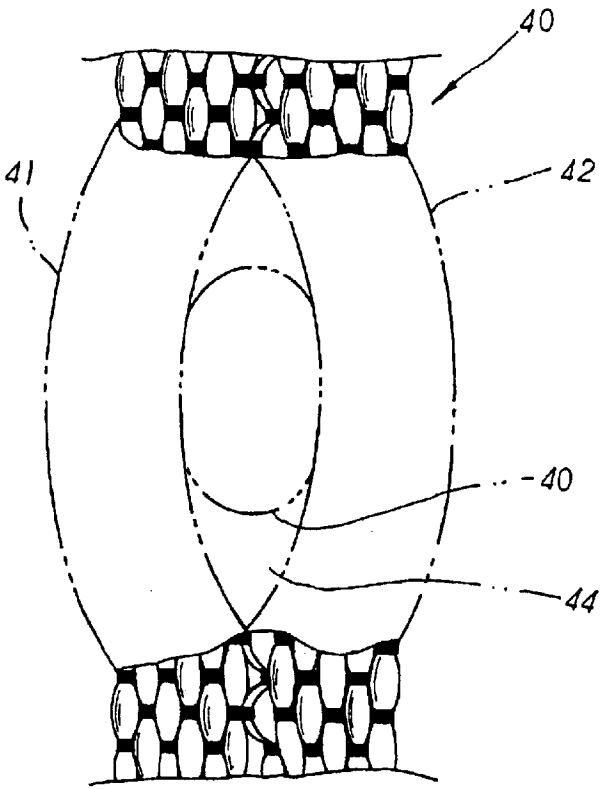
FIG. 6 is a sectional view of the present invention in practical use.
Figure 5:
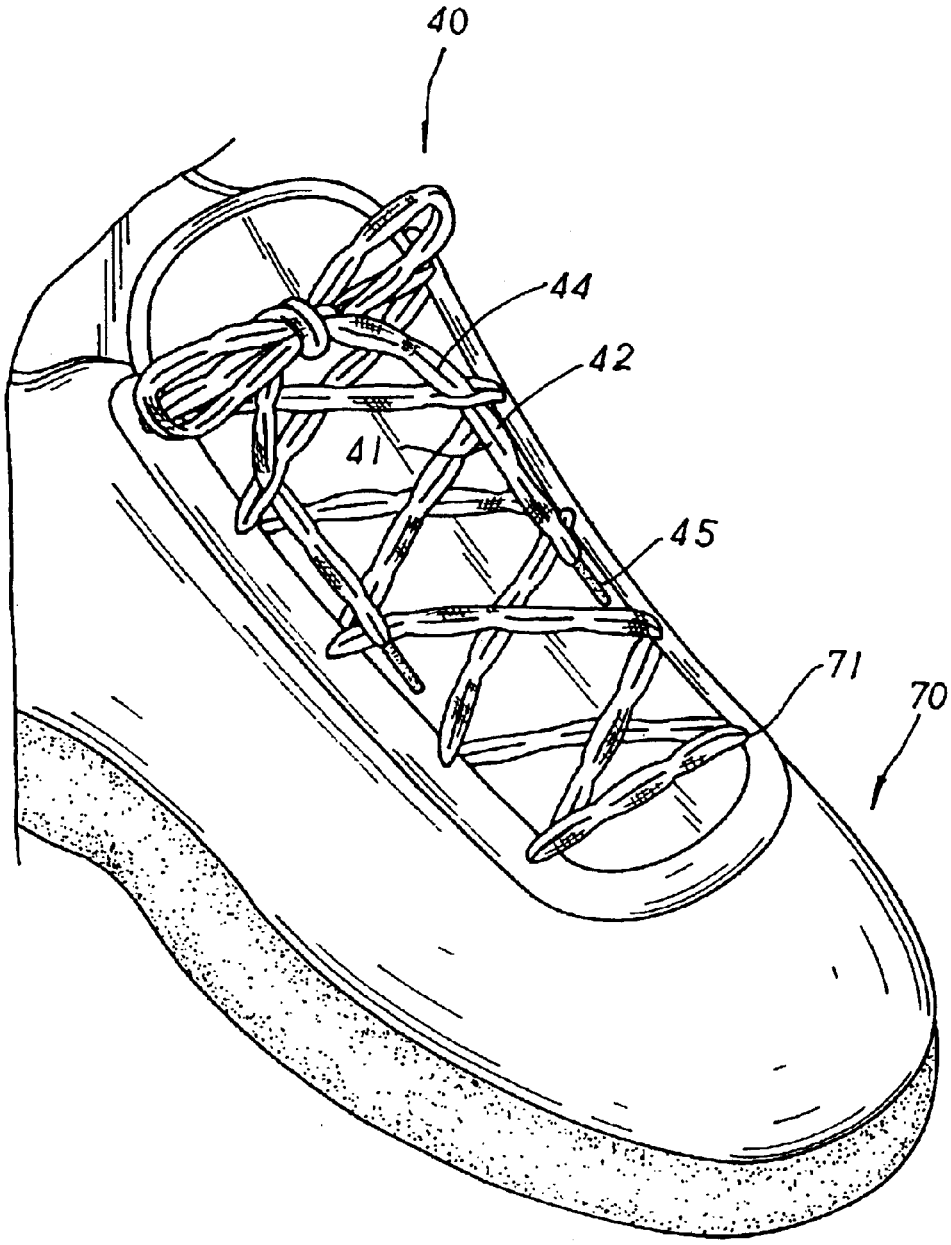
FIG. 5 is a perspective view of the present invention in practical use.
Figure 7:
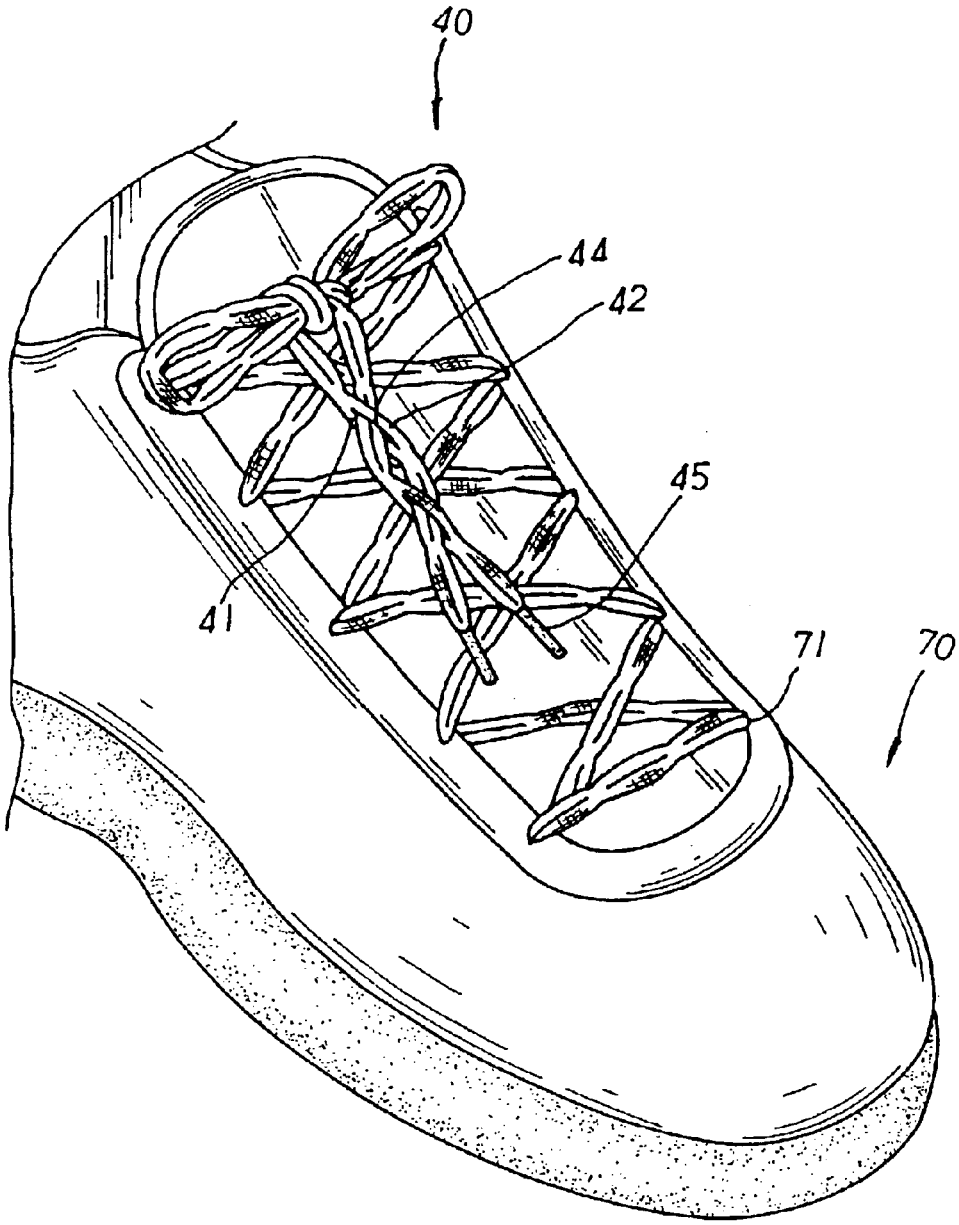
FIG. 7 is another embodiment of the present invention in practical use.

Please refer to FIG. 5. In practical use, caps 45 are adapted at both ends of the shoelace 40, tying up the left and right branches 41, 42 disposed thereon into one piece. The shoelace 40 is then led through buttonholes 71 of a shoe body 70 via the caps 45 thereof and tied up into a knot. Both ends of the shoelace 40 are then led by the caps 45 thereof to pass through the elastic tying sections 44 respectively and be held there-between at the left and right branches 41, 42 for further location thereof as shown in FIG. 6. When the knot of the shoelace 40 gets loose, the shoelace 40 will still be held at the elastic tying sections 44 of the left and right branches 41, 42 by both ends thereof for double protection of the users in case of walking, running, or cycling. Besides, both ends of the shoelace 40 led by the caps 45 respectively can also pass through the elastic tying sections 44 in crisscross manner for more variety thereof in practical use as shown in FIG. 7.

What is claimed is:

1. A multi-purpose shoelace structure, comprising a shoelace flatly woven via multiple layers of side-by-side warps yarns and weft yarns interlacing back and forth the warp yarns thereof wherein a left and a right branches are formed by the interlaced warp and weft yarns respectively with a multiple of interwoven sections formed at preset positions of the left and right branches thereon, and a multiple of elastic tying sections each separated from the others by the interwoven sections thereof being equidistantly defined by the left and right branches thereof;

whereby, when the shoelace is stringed through buttonholes of a shoe body and tied up into a knot, both ends of the shoelace are led through the elastic tying sections and be held there-between at the left and right branches thereof for double protection in case the knot gets loose when the users are walking, running, or cycling.

2. The multi-purpose shoelace structure as claimed in claim 1 wherein the interwoven sections are formed by weft yarns equidistantly interlaced with the warp yarns at preset positions of the left and right branches thereof.

3. The multi-purpose shoelace structure as claimed in claim 1 wherein the elastic tying sections can be flexible stretched out and closed up.

4. The multi-purpose shoelace structure as claimed in claim 1 wherein the elastic tying sections can be adjusted in size according to that of the shoelace thereof.

* * * * *